US005325958A

United States Patent [19]

Arasim

[11] Patent Number: 5,325,958

[45] Date of Patent: Jul. 5, 1994

[54] COMBINATION PAINT TRAY AND STORAGE BOX

[75] Inventor: James D. Arasim, Racine, Wis.

[73] Assignee: Western Publishing Co., Inc., Racine, Wis.

[21] Appl. No.: 13,755

[22] Filed: Feb. 4, 1993

[51] Int. Cl.[5] ..... B44D 3/04

[52] U.S. Cl. ..... 206/1.8; 206/1.7

[58] Field of Search ..... 206/1.7-1.9, 206/81, 575

[56] References Cited

U.S. PATENT DOCUMENTS

| | | | |
|---|---|---|---|
| 924,865 | 6/1909 | Wilson | 206/1.8 |
| 1,193,181 | 8/1916 | Peck | 206/1.7 |
| 1,349,217 | 8/1920 | Mentzer | 206/1.8 |
| 1,478,242 | 12/1923 | Milliken | 206/1.8 |
| 1,516,175 | 11/1924 | Daniel | 206/1.8 |
| 1,835,884 | 12/1931 | Lindsey | 206/1.8 |
| 2,221,191 | 11/1940 | James | 206/1.8 |
| 2,565,912 | 8/1951 | Davis | 41/4 |
| 2,806,312 | 9/1957 | Grumbacher | 206/1.7 |
| 3,023,884 | 3/1962 | Schwartz | 206/1.7 |
| 3,188,036 | 6/1965 | Sprung | 248/205 |
| 3,389,945 | 6/1968 | Thomas | 312/231 |
| 3,426,888 | 2/1969 | Meth | 206/1.8 |
| 3,760,973 | 9/1973 | Canning et al. | 220/23.8 |
| 4,638,909 | 1/1987 | Ford | 206/1.7 |
| 4,765,457 | 8/1988 | Rayle | 206/1.7 |

FOREIGN PATENT DOCUMENTS

| | | | |
|---|---|---|---|
| 1931704 | 2/1970 | Fed. Rep. of Germany | 206/1.8 |
| 8203018 | 2/1984 | Netherlands | 206/1.8 |

*Primary Examiner*—Jimmy G. Foster
*Attorney, Agent, or Firm*—Amster, Rothstein & Ebenstein

[57] ABSTRACT

A combination tray and box for storing a plurality of paint colors therein, the apparatus comprising an elongated substantially rectangular housing being generally defined by a planar bottom and four sides, the housing having an open top whereby a storage tray insert may be removably fitted within the interior of the housing, the insert having a plurality of paint storage wells and transverse raised ribs defined along the longitudinal extent of the top surface thereof and juxtaposed between adjacent wells, the insert further having an exterior perimeter less than the interior perimeter of the housing so as to define a channel therebetween for accumulation of excess paint and water residue, the housing further including a cover associated therewith for protecting the tray contents when not in use.

1 Claim, 4 Drawing Sheets

COMBINATION PAINT TRAY AND STORAGE BOX

BACKGROUND OF THE INVENTION

1. Field of the Invention

This invention relates generally to an apparatus for storing and dispensing liquids, and more particularly, to a combination paint tray and storage box for storing a plurality of water color paints in adjacent paint wells, the tray having integral means for preventing paint intermixture and further having a channel for drawing away excess paint and water residue.

2. Description of the Prior Art

Painting sets or containers for storing a plurality of paints are known in the art and embodied in a vast array of different configurations. Because painting with water colors is a favorite hobby and occupation of youngsters and adults alike, numerous types of painting sets have been made available which simplify the task at hand. Typically, these sets are small, and have individual colors of paint stored in a plurality of wells located in very close proximity to one another. One of the problems designers have been confronted with, is the undesirable intermixture of paint between wells during use. As a remedy, different configurations have been tried with varied success. One approach is to segregate the apparatus into wells bounded by raised areas or ribs to prevent such mixing of paint therebetween.

An example of a paint set which uses functional ribs is embodied in U.S. Pat. No. 2,565,912, issued to Davis. The Davis reference teaches a circular palette which includes a plurality of radially located raised ribs, each of which extends vertically a nominal distance, disposed between adjacent paint wells. Another device employing raised ribs is taught in U.S. Pat. No. 3,426,888, issued to Meth. Yet another invention for storing a plurality of paint colors in a number of wells is disclosed in U.S. Pat. No. 3,389,945, issued to Thomas.

A related problem associated with water color paint sets, is the accumulation of paint and water residue in the area immediately surrounding each well. When a user removes a particular color of paint with a moist brush, the excess paint must be wiped off prior to its application on a painting surface. Typically, the artist wipes the brush on flat areas proximal to the well edge. Eventually, excessive amounts of paint and water accumulate where spillage between adjacent wells, intermixture of paint and messy overflow can occur, notwithstanding the presence of elevated ribs. Remedial measures to drain this excess liquid away from the well area have been tried in the art.

In the Davis patent, the circular palette is situated atop a cylindrincal water vessel in fluidic communication therewith. Excess liquids are gravity drained away from the annular surface surrounding each well and into the water vessel. However, this apparatus suffers from a major drawback in that the relatively bulky water vessel must be used to accumulate excess paint and water. Moreover, no means are provided for covering and protecting the paint when the tray is not in use.

Still other types of receptacles for storing paint are disclosed in U.S. pat. No. 3,023,884, issued to Schwartz, U.S. Pat. No. 3,760,973 issued to Canning et al. and U.S. Pat. No. 3,188,036 issued to Sprung. These all teach sealable containers for paint storage in multiple receptacles. However, none of these function as a paint tray where excess paint and water may be drained away into the device and discarded at a later time.

Accordingly, the present invention is directed to overcoming the aforementioned shortcomings apparent in the prior art, by providing a combination paint tray and storage box which includes integral means for preventing paint intermixture, draining excess paint and water residue, and covering the tray while not in use.

SUMMARY OF THE INVENTION

The present invention is directed to a combination tray and storage box suitable for use as a water color paint set. The apparatus is generally comprised of a housing and removable storage tray insert, the housing including a cover associated therewith for covering the tray when not in use.

In the preferred embodiment, the housing is comprised of a formed plastic which is molded into an elongated, open ended box of nominal wall thickness, defined by four sides and a planar bottom. The four sides collectively define an interior perimeter and volume. The bottom has a first side disposed to the interior of the box, and a second side which is adapted to rest on a working surface.

The storage tray insert is unitarily molded by vacuum forming or equivalent methods, into a body defined by a top surface which blends into a plurality of side walls and terminates in a peripheral flange which forms a lower support surface. The exterior perimeter of the body is somewhat less than the interior perimeter of the housing such that, when the insert is situated within the housing, a continuous channel is defined. The top surface of the body includes a plurality of integrally molded paint wells for storing different colors of paint, each having an elliptical planform which extends downwardly from the top to define a storage volume. A plurality of raised ribs are similarly formed in the body, disposed transversely between adjacent paint wells in a linear relationship along the longitudinal extent thereof. A small flat area remains in the area immediately surrounding each well opening, which allows the user to wipe off excess paint and water by squeezing a paint brush thereon. The ribs prevent intermixture between adjacent wells, impart increased lateral stiffness to the body, and assist in directing the excess paint and water mixture into the aforementioned channel. The channel additionally serves as a convenient storage area for a paint brush.

The cover is preferably constructed in a manner similar to the housing, and may be transparent to permit viewing the tray contents. It includes means for pivotal attachment to the housing to maximize convenience and ease of operation.

In accordance with the present invention, it is an object thereof to provide a combination paint tray and storage box which comprises an elongated housing and removable compartmentalized tray.

It is a further object of the invention to provide a combination paint tray and storage box in which the tray includes a plurality of paint wells separated by integrally molded raised ribs to prevent paint intermixture and enhance overall structural rigidity.

It is yet another object of the instant invention to provide a combination paint tray and storage box which includes an integral run off channel for accumulating excess paint and water residue in combination with a plurality of contiguous paint wells bounded by integrally molded raised ribs which prevent paint intermixture and direct said paint and water residue into said channel.

In accordance with these and other objects which will become apparent hereinafter, the instant invention will now be described with particular reference to the accompanying drawings.

DETAILED DESCRIPTION OF THE PREFERRED EMBODIMENT

Figure 1:
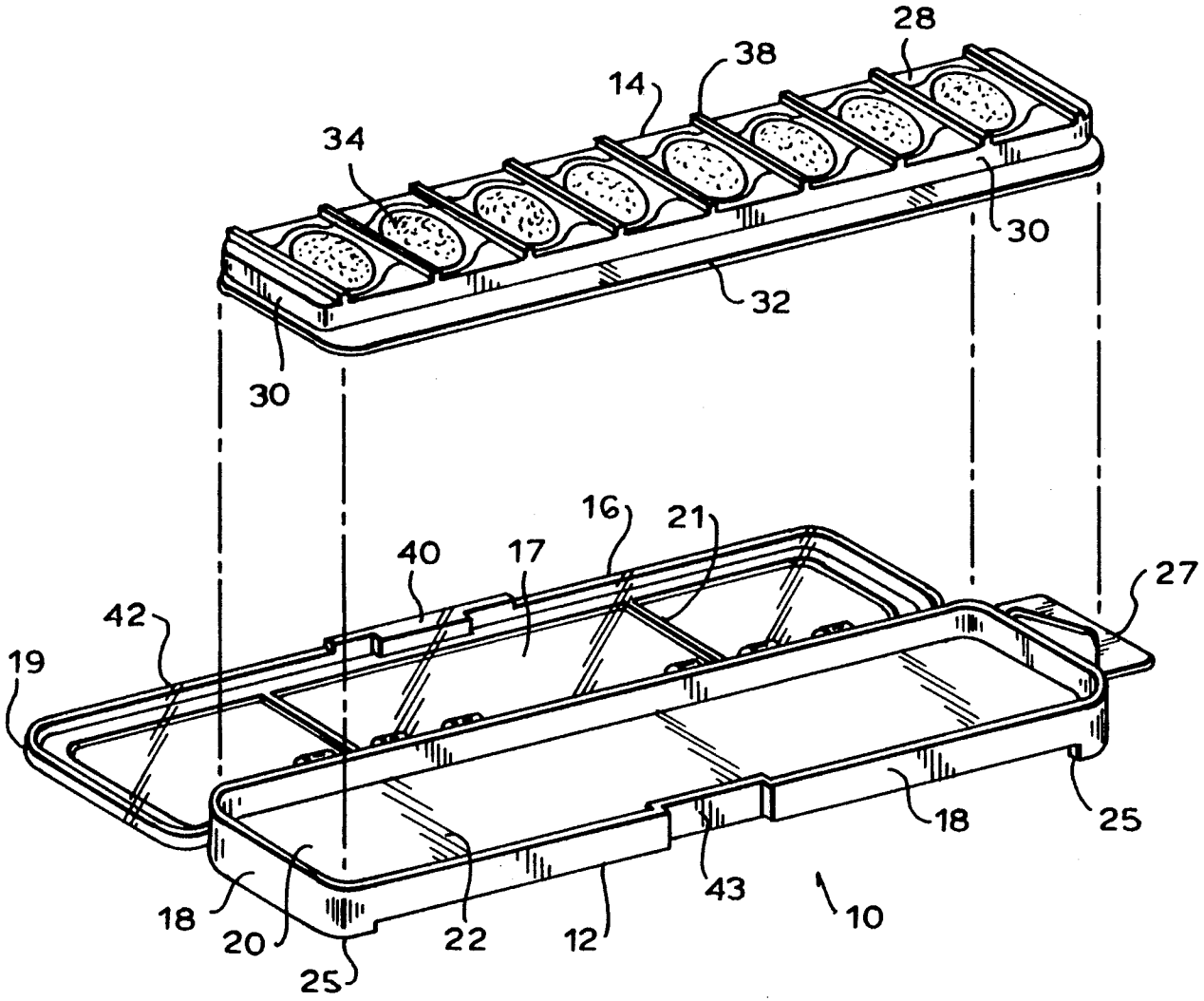
FIG. 1 is an exploded perspective view of the paint tray.

With reference to the several views in the drawings, there is depicted a COMBINATION PAINT TRAY AND STORAGE BOX generally characterized by the reference numeral 10. The apparatus 10 is generally comprised of a housing 12; storage tray insert 14; and cover 16.

Figure 2:
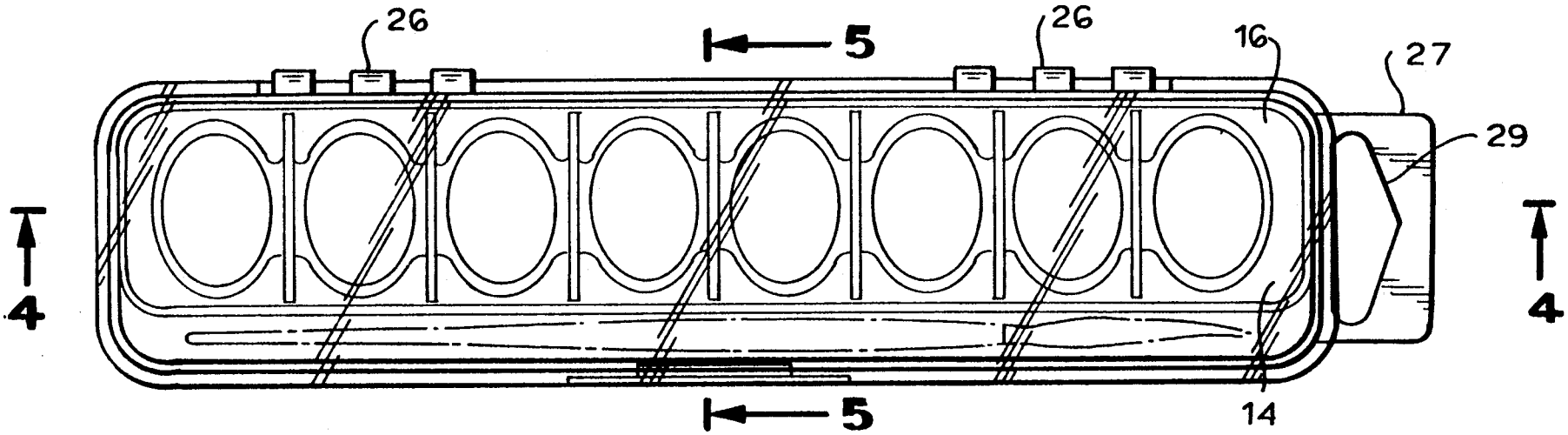
FIG. 2 is a top plan view thereof with the cover closed.
Figure 3:
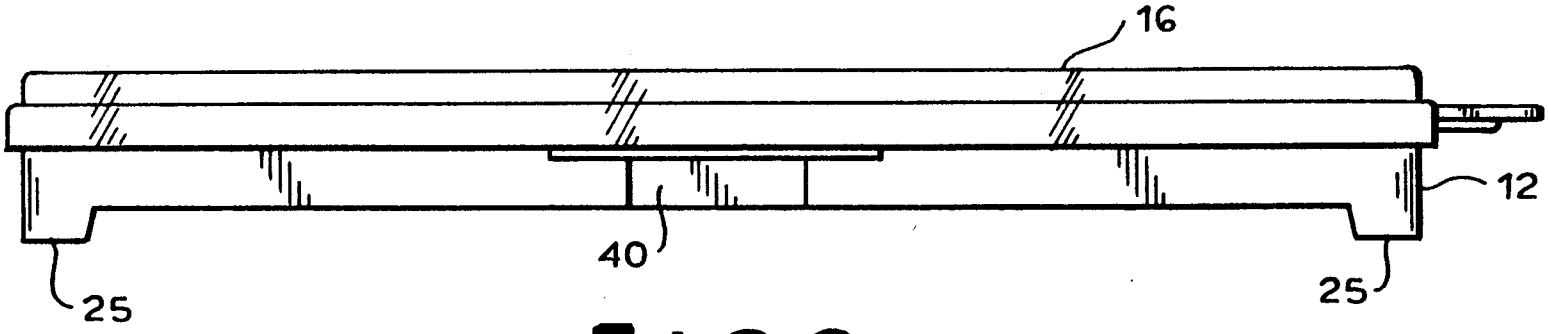
FIG. 3 is a frontal view detailing the latch.

Referring now to FIGS. 1-7, housing 12 may be fabricated from vacuum formed or injection molded plastic, or from equivalent materials and by methods of manufacture as is well-known in the art. Housing 12 has a nominal wall thickness t1, and is defined by four elongated sides 18 which terminate in a planar bottom 20 and an open top end. Bottom 20 has a first side 22 disposed to the interior of housing 20, and a second side 24 which is adapted to rest on a support surface by means of legs 25 which are integral with sides 18. Hinge means 26 are provided along the top edge of one of the sides 18 for pivotally attaching cover 16 which will be described in greater detail hereinbelow. A tab 27 extending outwardly from housing 12 is provided for storage or grasping purposes. Tab 27 defines aperture 29 therethrough as best illustrated in FIG. 2.

Figure 4:
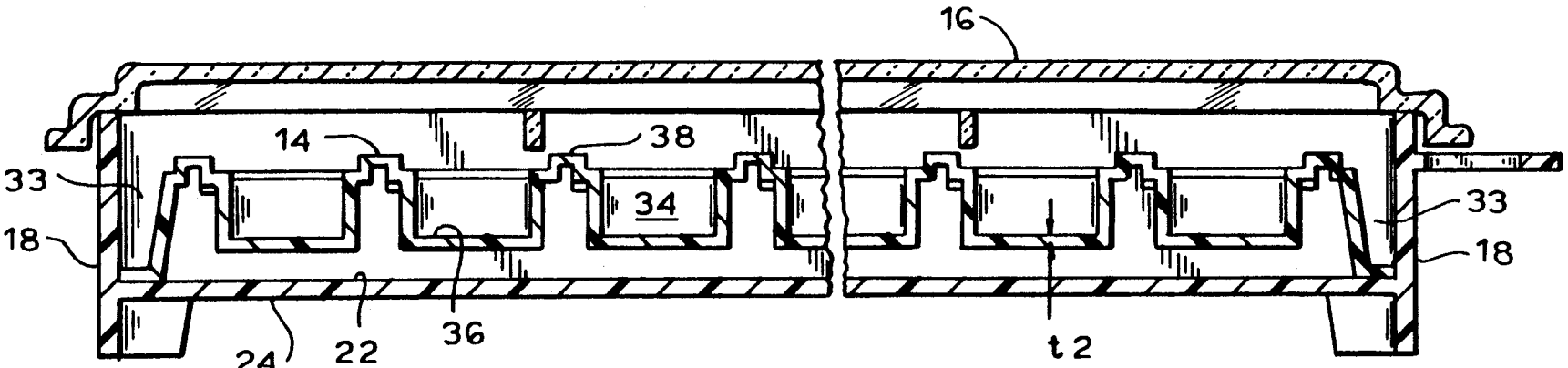
FIG. 4 is an enlarged fragmentary longitudinal section along line 4—4 of FIG. 2.
Figure 5:
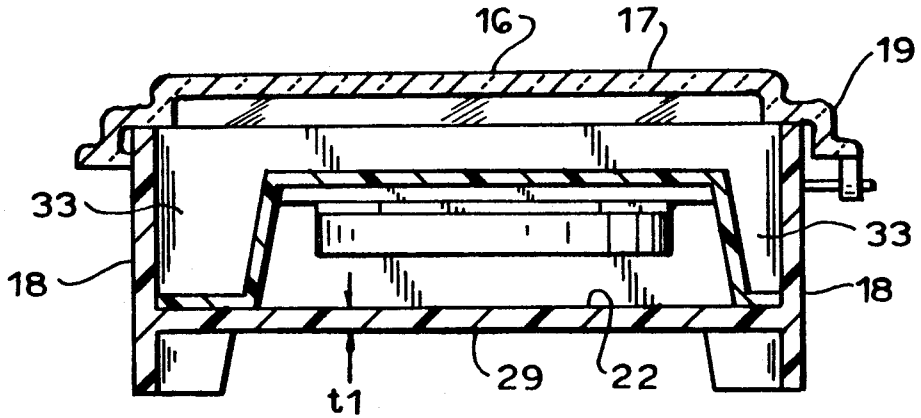
FIG. 5 is an enlarged transverse section along line 5—5 of FIG. 2.
Figure 6:
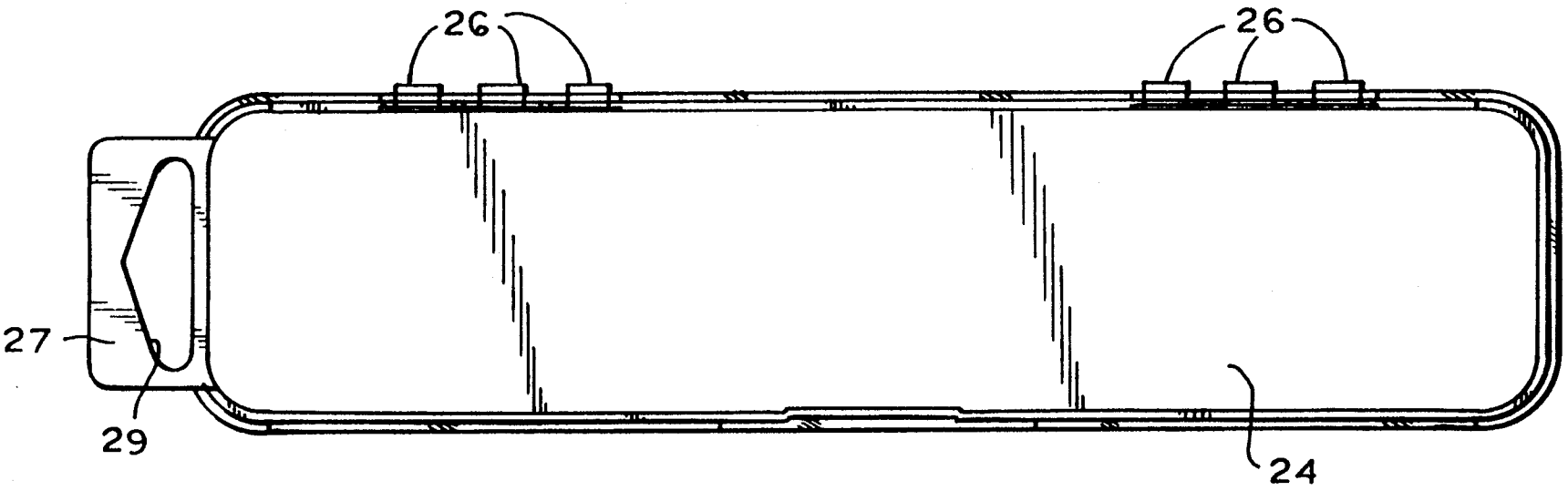
FIG. 6 is a bottom view of the paint tray.
Figure 7:
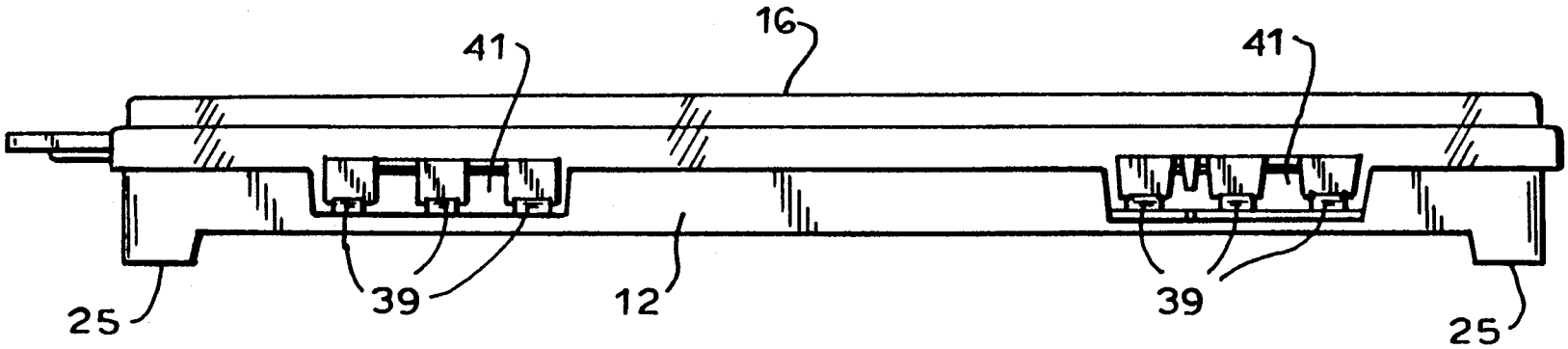
FIG. 7 is a rear view thereof.

Storage tray insert 14 is configured to fit within the interior volume defined within housing 12. Insert 14 is fabricated from vacuum formed or injection molded plastic, or by alternative methods as described above. Insert 14 comprises a body of nominal wall thickness t2 defined by a top surface 28 which blends into four side walls 30 and terminates in a peripheral flange 32. To facilitate the molding process, a draft angle running continuously around the interior perimeter defined by side walls 30 may be incorporated. Flange 32 is formed in the molding process and provides a support surface which rests on first side 22 of housing bottom 20. The exterior perimeter of insert 14 is somewhat less than the interior perimeter of housing 12, such that when situated within the interior volume of housing 12, a channel 33 for accumulating excess paint and water is defined therebetween as best seen in FIGS. 4 and 5. Channel 33 additionally serves as a convenient storage area for a brush 35.

The top surface 28 of insert 14 includes a plurality of unitarily formed paint wells 34 which extend linearly along the longitudinal extent thereof, each having an elliptical planform extending downwardly to a bottom surface 36. A plurality of raised ribs 38 are similarly formed in top surface 28, juxtaposed laterally between contiguous paint wells 34, and tangent to the minor diameter of the elliptical planform thereof. Ribs 38 prevent accidental intermixture of paint between adjacent wells, direct residue into channel 33 and impart lateral stiffness to insert 14 thereby allowing thinner construction. To facilitate the molding process, generous radii may be included in the body planform and along the peripheral edge where each well 34 joins top surface 28 as best illustrated in FIGS. 1 and 2.

Cover 16 is preferably manufactured from transparent molded plastic, and is pivotally attached to housing 20 by hinge means 26 or equivalent conventional methods. The cover includes a flat top portion 17, flanged edge 19 and lateral stiffner members 21. Hinge means 26 comprises a plurality of unitarily molded, arcuate fingers 39 extending outwardly from the rear wall 18 of housing 12, and a pair of molded slotted shafts 41 in cover 16, hingedly mounted therein. A latch provision 40 may be incorporated into the cover edge 19, disposed opposite hinge means 26 for engaging a corresponding structure 43 molded in the appropriate wall 18 of housing 20 to protect the tray contents and facilitate portability.

To use the tray, the painter simply dips a moist paint brush into the desired paint color stored within the appropriate well 34. Any excess paint and water may be wiped off on body top surface 28 in the area proximal to the well periphery by squeezing the brush against surface 28. Ribs 38 prevent accidental paint spillage between wells during normal usage, and assist in channeling excess water and paint buildup on surface 28 into channel 33. When draining the accumulated residue, insert 14 may be removed from housing 20 and the excess mixture discarded.

The instant invention has been shown and described in what is considered to be the most practical and preferred embodiment. It is anticipated, however, that departures may be made therefrom, and that obvious modifications will be implemented by a person skilled in the art.

I claim:

1. A combination tray and box for storing and using a plurality of paint colors, comprising:

an elongated housing being generally defined by a planar bottom and four sides where said four sides define an interior perimeter and interior volume, said planar bottom having a first side disposed to the interior of said housing, and a second side disposed to the exterior of said housing;

insert means for storing paint, said insert means comprising a molded, unitarily formed body defined by a plurality of sidewalls which terminate in a peripheral flange, said body having an exterior perimeter less than said interior perimeter of said housing where said body is adapted to fit within said interior volume of said housing and rest against said first side of said planar bottom thereof, thereby defining a channel between said insert and said interior perimeter of said housing, said body defining a plurality of adjacent paint wells disposed in a linear relationship along the longitudinal extent thereof, each having an elliptical planform extending downwardly from an open top end to a closed bottom end, and a plurality of transverse raised ribs, each juxtaposed between adjacent paint wells and extending transversely between two of said sidewalls to segregate an area adjacent each well; and cover means associated with said housing for concealing said interior volume and said insert means, said cover means pivotally attached to said housing along one of said four sides thereof.

* * * * *